US010717588B2

(12) United States Patent
Luchak

(10) Patent No.: US 10,717,588 B2
(45) Date of Patent: Jul. 21, 2020

(54) BEVERAGE CONTAINER INSULATOR

(71) Applicant: Peter W. Luchak, London (CA)

(72) Inventor: Peter W. Luchak, London (CA)

( * ) Notice: Subject to any disclaimer, the term of this patent is extended or adjusted under 35 U.S.C. 154(b) by 57 days.

(21) Appl. No.: 16/273,380

(22) Filed: Feb. 12, 2019

(65) Prior Publication Data

US 2019/0168947 A1 Jun. 6, 2019

Related U.S. Application Data

(63) Continuation of application No. 16/158,617, filed on Oct. 12, 2018, now Pat. No. 10,472,159, which is a continuation-in-part of application No. 15/975,215, filed on May 9, 2018, now Pat. No. 10,183,799.

(60) Provisional application No. 62/582,087, filed on Nov. 6, 2017.

(51) Int. Cl.
*B65D 81/38* (2006.01)
*B65D 25/22* (2006.01)

(52) U.S. Cl.
CPC ..... *B65D 81/3876* (2013.01); *B65D 25/22* (2013.01); *B65D 81/3879* (2013.01); *B65D 2203/02* (2013.01)

(58) Field of Classification Search
CPC ..... B65D 81/3879; B65D 81/3876; B65D 81/38; B65D 3/22; B65D 25/22; B65D 25/20
USPC ..... 220/739, 737, 592.26, 903, 601, 694; 229/403; 215/395, 386; 40/310, 306; 206/459.5
See application file for complete search history.

(56) References Cited

U.S. PATENT DOCUMENTS

| | | | |
|---|---|---|---|
| 4,540,611 | A | 9/1985 | Henderson |
| 5,595,069 | A | 1/1997 | Gies |
| 6,276,579 | B1 | 8/2001 | DeLoach |
| 9,615,684 | B2 | 4/2017 | Deakin et al. |
| 9,856,068 | B2 | 1/2018 | Jody |
| 2004/0182870 | A1 | 9/2004 | Rodgers |
| 2008/0164269 | A1 | 7/2008 | Vorderkunz |
| 2009/0294317 | A1 | 12/2009 | Villhard, Jr. |
| 2010/0130339 | A1 | 5/2010 | Junkins |
| 2016/0046430 | A1 | 2/2016 | Tractenberg |
| 2018/0235297 | A1 | 8/2018 | Buczkowski et al. |

FOREIGN PATENT DOCUMENTS

WO 2007134377 A1 11/2007

OTHER PUBLICATIONS

Extended European Search Report filed in corresponding European application; 9 pages.

*Primary Examiner* — Robert J Hicks
(74) *Attorney, Agent, or Firm* — Black, McCuskey, Souers & Arbaugh LPA

(57) ABSTRACT

A beverage container insulator can include a body, a web, first and second surfaces defined on opposite sides of the body, a plurality of apertures, and a closure assembly. The body can extend about an axis and have an opening to receive a beverage container. The web can at least partially close a second end of the body to prevent the beverage container from passing fully through the body. The plurality of apertures can be positioned at the second end. The closure assembly can be positioned at the first end and can have first and second closure members affixed to opposite portions of the second surface of the body at the opening. The first and second closure members can be selectively engageable with one another to selectively and substantially close the center of the opening.

16 Claims, 9 Drawing Sheets

BEVERAGE CONTAINER INSULATOR

CROSS-REFERENCE TO RELATED APPLICATIONS

This application is a continuation-in-part of U.S. patent application Ser. No. 16/158,617 for a BEVERAGE CONTAINER INSULATOR, filed on Oct. 12, 2018, which is hereby incorporated by reference in its entirety, which is a continuation-in-part of U.S. patent application Ser. No. 15/975,215 for a BEVERAGE CONTAINER INSULATOR, filed on May 9, 2018, issued on Jan. 22, 2019 as U.S. Pat. No. 10,183,799, which itself claimed priority to United States Provisional Patent Application Ser. No. 62/582,087 for a FOLD DOWN BEVERAGE INSULATOR SYSTEM, filed on Nov. 6, 2017. All of these priority applications are hereby incorporated by reference in their entireties.

BACKGROUND

1. Field

The present disclosure relates to insulating sleeves or jackets for cans, bottles, barrels, etc, as found in B65D 81/3876 of the Cooperative Patent Classification system.

2. Description of Related Prior Art

U.S. Pub. No. 2012/0243808 discloses INSULATED LINERS AND CONTAINERS. An insulated shipping liner includes a flexible sealed sack having a first layer and second layer sealed together about their outer peripheral edges to form a housing. An insulating layer made from a single sheet of foam material is located within the housing and is configured to be folded such that a first side portion, second side portion and middle portion create a substantially rectangular box form, with the first and second side portions defining opposing sides of the box form, the middle portion defining a bottom of the box form, the substantially rectangular top flap defining at least part of a top of the box form, and the opposing substantially rectangular first and second side flaps defining at least part of other opposing sides of the box form. The box form can be placed in a container to form an insulated container for shipping and/or storage.

U.S. Pat. No. 4,540,611 discloses a FOLD-UP INSULATED BEVERAGE CONTAINER HOLDER. The '611 patent discloses a one piece beverage insulator in the form of a beverage container holder with an open top that is die cut from a sheet of insulative foam either open cell or closed cell laminated with a surface vinyl film. The one piece beverage insulator die cut pattern is in the form of two mirror image side halves joined by a center bottom shaped to conform to the bottom of a beverage container to be held by the finished holder. The die cut holder pattern is folded over on itself with the side halves aligned but with the inside foam sides of the halves facing out and the side edges are stitched or vinyl welded together after which the holder is pulled inside out through its open top returning the vinyl surface to the outside. This finished holder is stored in a collapsed flat state to be opened when receiving a beverage can or other beverage container to be held and insulated by the holder.

U.S. Pub. No. 2004/0182870 discloses a FOLDABLE BEVERAGE INSULATIVE GARMENT DEVICE AND METHOD OF USING. The device comprises: a jacket, a fastener, and a strap. The jacket has a generally circular base; a cylindrical side wall attached around the perimeter of the base; and a flap attached to the cylindrical side wall, in which the flap having a first and second edges. The jacket comprises: an outer cover; an interior layer attached to the outer cover; and an inner cover attached to the interior layer. The fastener is attached to the jacket, in which the fastener has a first and second components. The first component of the fastener is attached to the first edge of the flap, and the second component of the fastener is attached to the second edge of the flap so that the first and second components of the fastener are interconnectable together. When the first and second components are connected together then the fastener is in a locked position. When the first and second components are not connected together then the fastener is in an open position. The strap having a first and second ends, the first and second ends of the strap are attached to the jacket. The method of using the device comprises the steps of connecting, getting, grasping, inserting, lifting, obtaining, placing, portaging, retrieving, sipping, and wrapping.

U.S. Pub. No. 2016/0046430 discloses a CONVERTIBLE INSULATOR FOR A BOTTLE OR A CAN. A beverage insulator configurable to insulate a bottle in a bottle configuration, and a can in a can configuration, is disclosed. The beverage insulator includes a body for receiving and insulating a bottle or a can, and one or more foldable members to insulate a bottle neck in the bottle configuration, and a can in the can configuration. The can configuration allows a user to comfortably drink from the can without the foldable members interfering with the user's normal drinking action. The bottle configuration substantially insulates a bottle from a bottom of the bottle to a neck of the bottle.

The background description provided herein is for the purpose of generally presenting the context of the disclosure. Work of the presently named inventor, to the extent it is described in this background section, as well as aspects of the description that may not otherwise qualify as prior art at the time of filing, are neither expressly nor impliedly admitted as prior art against the present disclosure.

SUMMARY

A beverage container insulator can include a body, a web, first and second surfaces defined on opposite sides of the body, a plurality of apertures, and a closure assembly. The body can define a cylinder extending about an axis. The body can have an opening at a first end to receive a beverage container. The body can have a second end that is opposite to the first end relative to a height of the body, wherein the height can be defined along the axis and wherein the axis can extend through a center of the opening. The web can be fixed with the body, at least partially closing the second end, and can be configured to prevent the beverage container from passing fully through the body. The first and second surfaces can extend along the axis between the first and second ends. At least one of the first and second surfaces can be configured to receive and contact the beverage container when the beverage container is received in the body. The plurality of apertures can be positioned at the second end and can be spaced from the first end. Each of the plurality of apertures can be defined in the web or between the web and the second end of the body. The closure assembly can be positioned on the body at the first end and can be spaced from the second end. The closure assembly can be positioned closer to the first end along the axis than the plurality of apertures. The closure assembly can have first and second closure members affixed to opposite portions of the second surface of the body at the opening. The first and second closure members can be selectively engageable with one another to selectively and substantially close the center of the opening.

BRIEF DESCRIPTION OF THE DRAWINGS

The detailed description set forth below references the following drawings.

DETAILED DESCRIPTION

Figure 1:
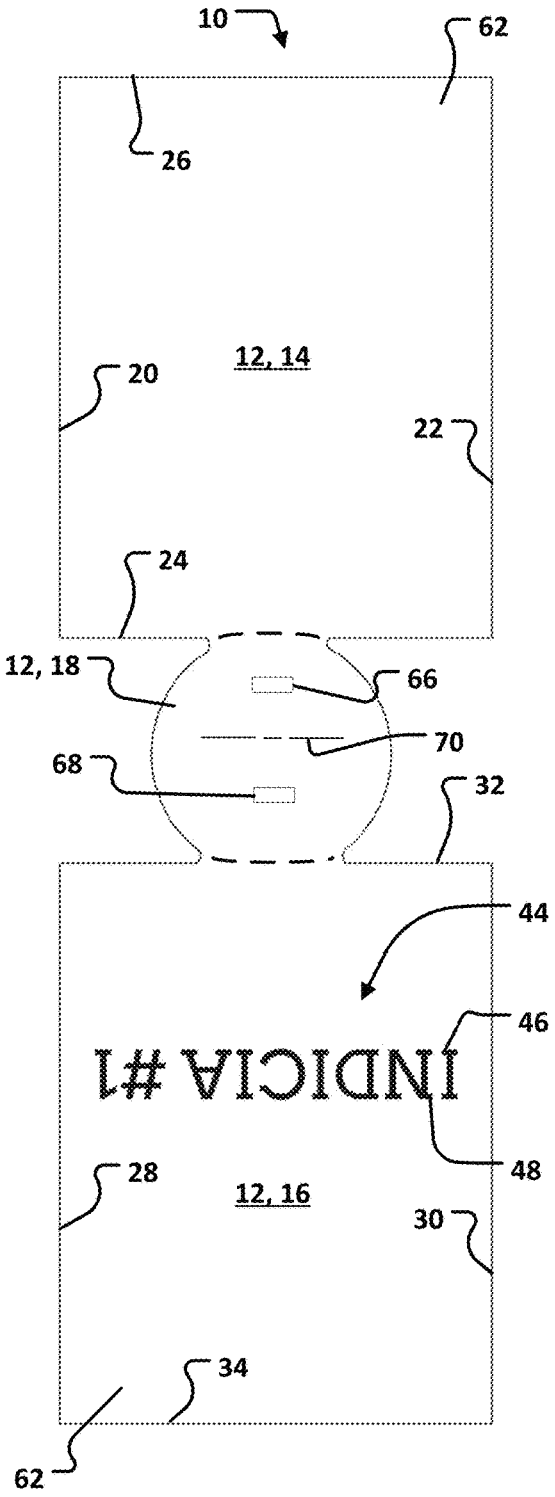
FIG. 1 is a top view of a blank that can be used to form an exemplary embodiment of the present disclosure.

A plurality of different embodiments of the present disclosure is shown in the Figures of the application. Similar features are shown in the various embodiments of the present disclosure. Similar features across different embodiments have been numbered with a common reference numeral and have been differentiated by an alphabetic suffix. Similar features in a particular embodiment have been numbered with a common two-digit, base reference numeral and have been differentiated by a different leading numeral. Also, to enhance consistency, the structures in any particular drawing share the same alphabetic suffix even if a particular feature is shown in less than all embodiments. Similar features are structured similarly, operate similarly, and/or have the same function unless otherwise indicated by the drawings or this specification. Furthermore, particular features of one embodiment can replace corresponding features in another embodiment or can supplement other embodiments unless otherwise indicated by the drawings or this specification.

The present disclosure provides a beverage container insulator that substantially departs conventional concepts and designs. The present disclosure provides an article of manufacture configured to receive a beverage container and thermally insulate the beverage container. But further, the present disclosure provides an article of manufacture bearing a first set of indicia on an outside surface and a second set of indicia on an inside surface. The first set of indicia can convey a first message and the second set of indicia can convey a second message. The present disclosure provides an article of manufacture that can insulate a beverage container in a safe, convenient, and economical manner.

In view of the disadvantages inherent in the known types of beverage insulators of known designs and configurations now present in the prior art, the present disclosure provides an improved beverage container insulator. As such, the general purpose of the present disclosure, which will be described subsequently in greater detail, is to provide a new and improved beverage container insulator which has all the advantages of the prior art and none of the disadvantages. In this respect, before explaining at least one embodiment of the present disclosure in detail, it is to be understood that the present disclosure is not limited in its application to the details of construction and to the arrangements of the exemplary embodiment set forth in the following description or illustrated in the drawings. Other embodiments of the present disclosure are capable of being practiced and carried out in various ways. Also, it is to be understood that the phraseology and terminology employed herein are for the purpose of descriptions and should not be regarded as limiting.

With reference now to the drawings, an embodiment of the present disclosure is defined by beverage container insulator 10. The exemplary beverage container insulator 10 includes a blank 12 of material. The exemplary blank 12 can be formed from neoprene. The blank 12 can be formed from other materials in other embodiments, such from a woven fabric, open cell foam, paper, rubber or silicone. An elastomeric material is a polymer with both viscosity and elasticity and relatively weak inter-molecular forces, generally having low Young's modulus and high failure strain compared with other materials. An elastomeric material displays rubber-like elasticity. Alternatively, the blank 12 can be formed from a combination of materials, including a layer of elastomeric material and a layer of fabric.

The exemplary blank 12 includes a first panel portion 14, a second panel portion 16, and a web 18 interconnecting the panel portions 14, 16. The first panel portion 14 extends between opposite edges 20, 22 and also between opposite edges 24, 26. The second panel portion 16 extends between opposite edges 28, 30 and also between opposite edges 32, 34. The web 18 extends between opposite edges 24 and 32. The web 18 is interconnected to the panel portion 14 along the edge 24. The web 18 is interconnected to the panel portion 16 along the edge 32.

Figure 5:
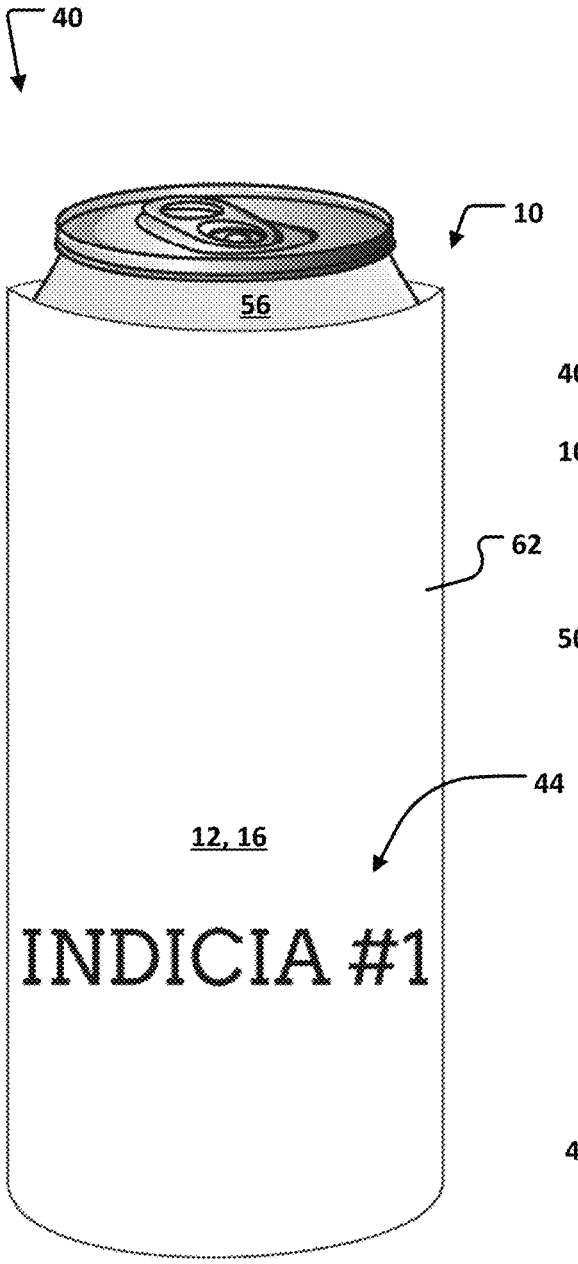
FIG. 5 is a perspective view of the beverage container insulator mounted on a beverage container and arranged in the first configuration (unfolded)
Figure 6:
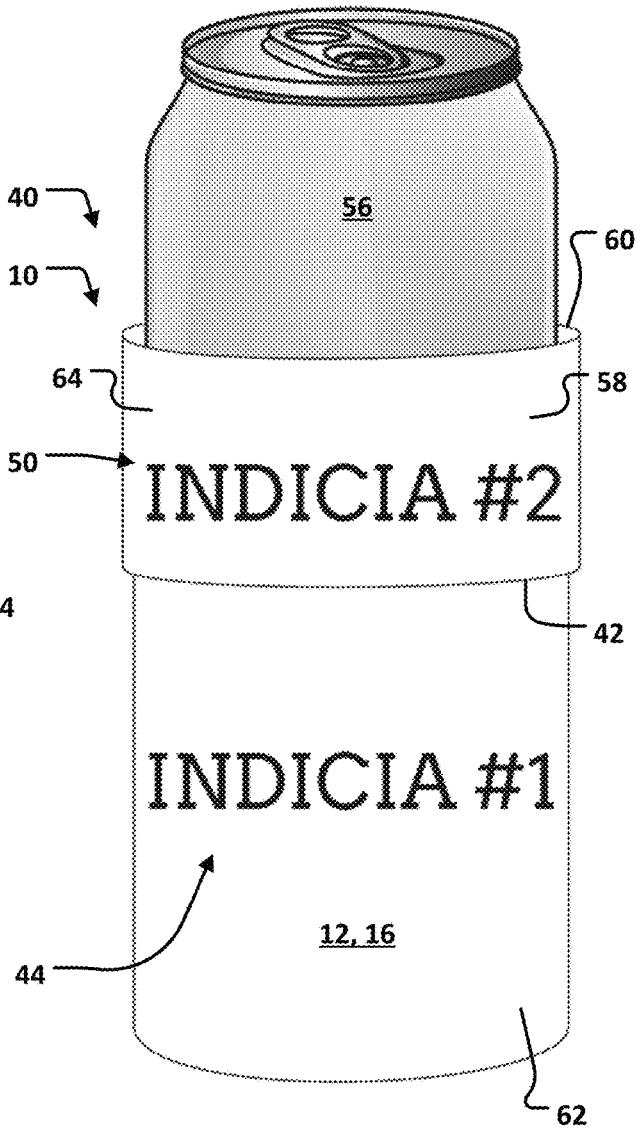
FIG. 6 is a perspective view of the beverage container insulator mounted on the beverage container and arranged in the second configuration (folded)
Figure 7:
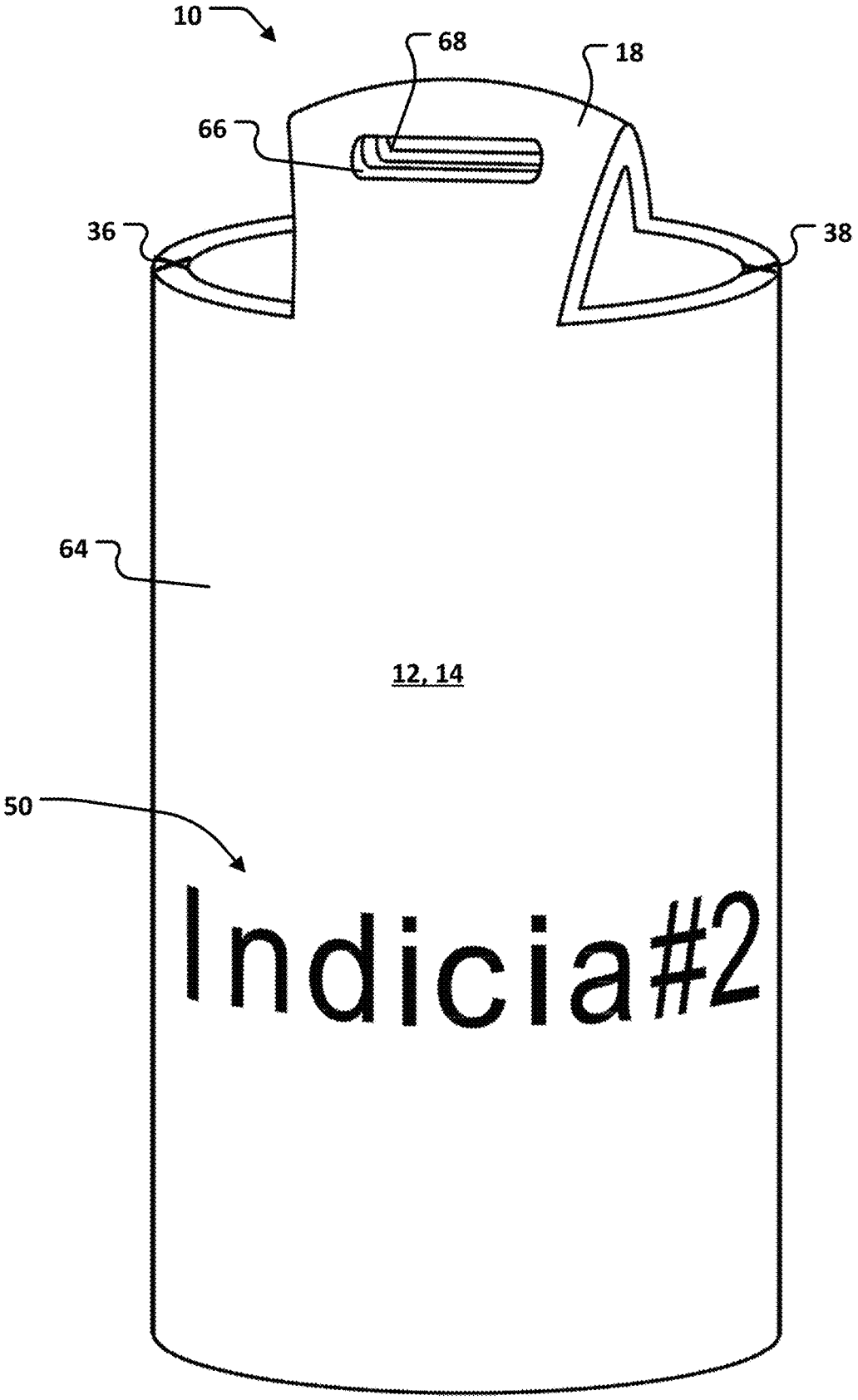
FIG. 7 is a perspective view of the beverage container insulator arranged inside-out for a further use.
Figure 8D:
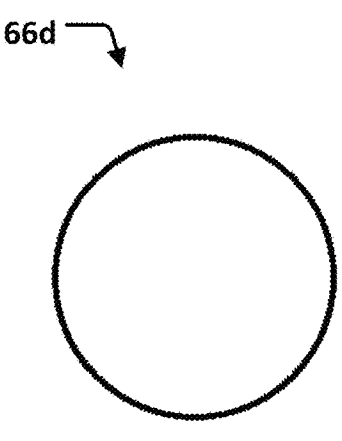
FIG. 8A-8D show various perimeters for apertures in the beverage container insulator.
Figure 8C:
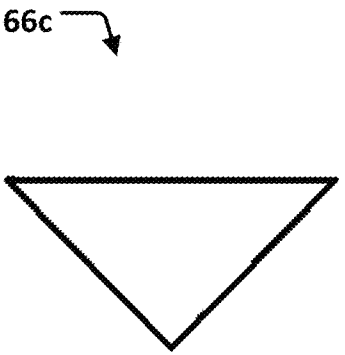
Figure 8B:
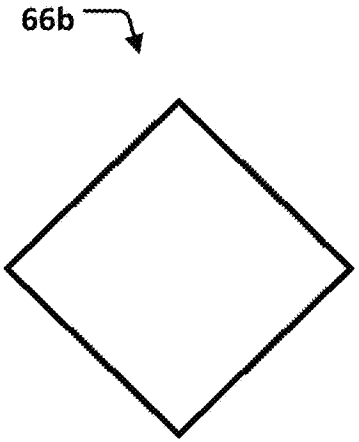
Figure 8A:
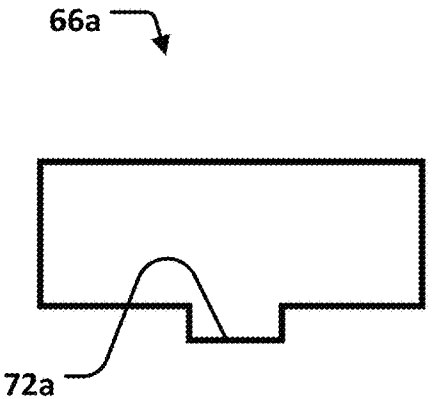
Figure 9:
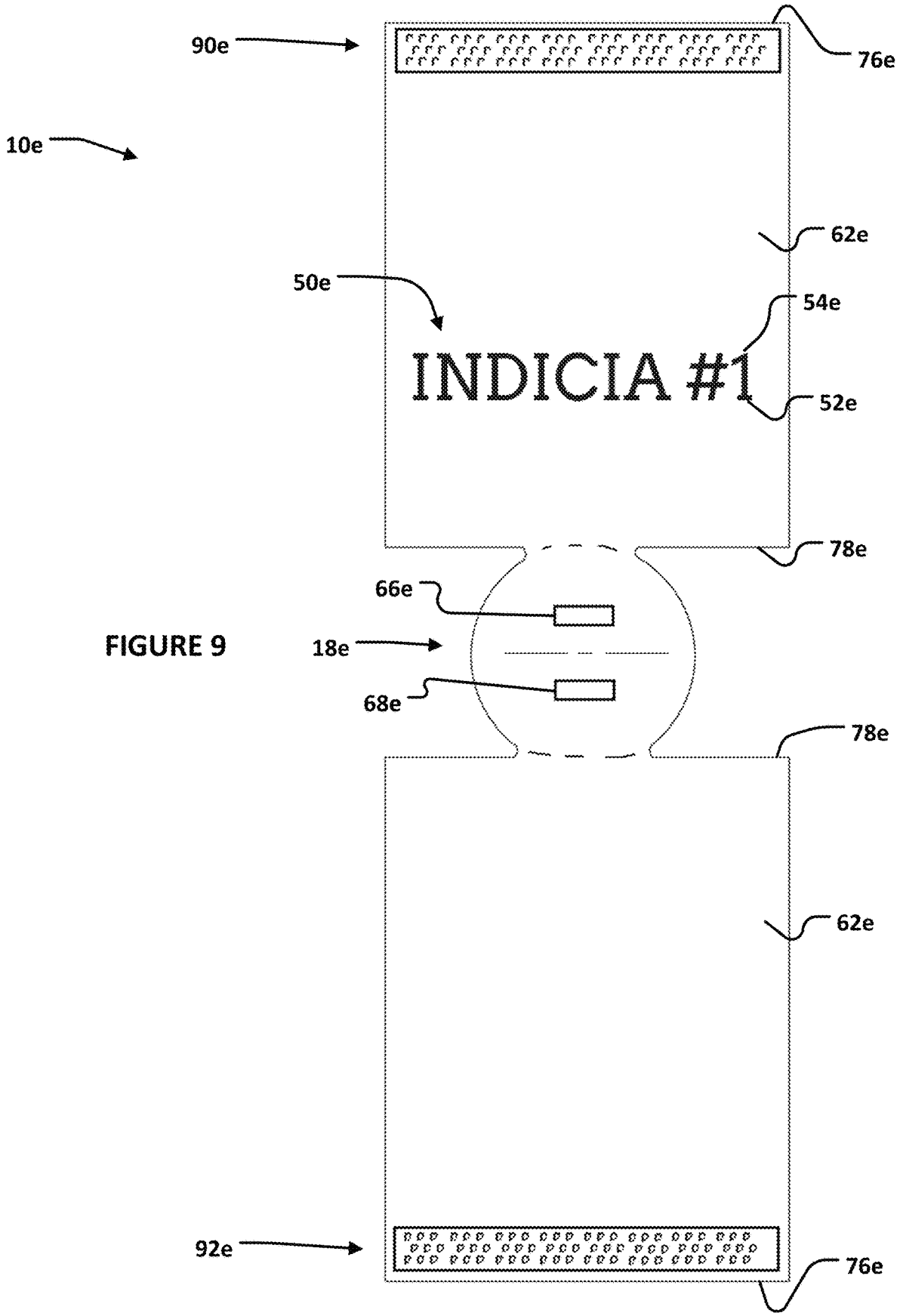
FIG. 9 is a top view of a blank that can be used to form an exemplary embodiment of the present disclosure.
Figure 10:
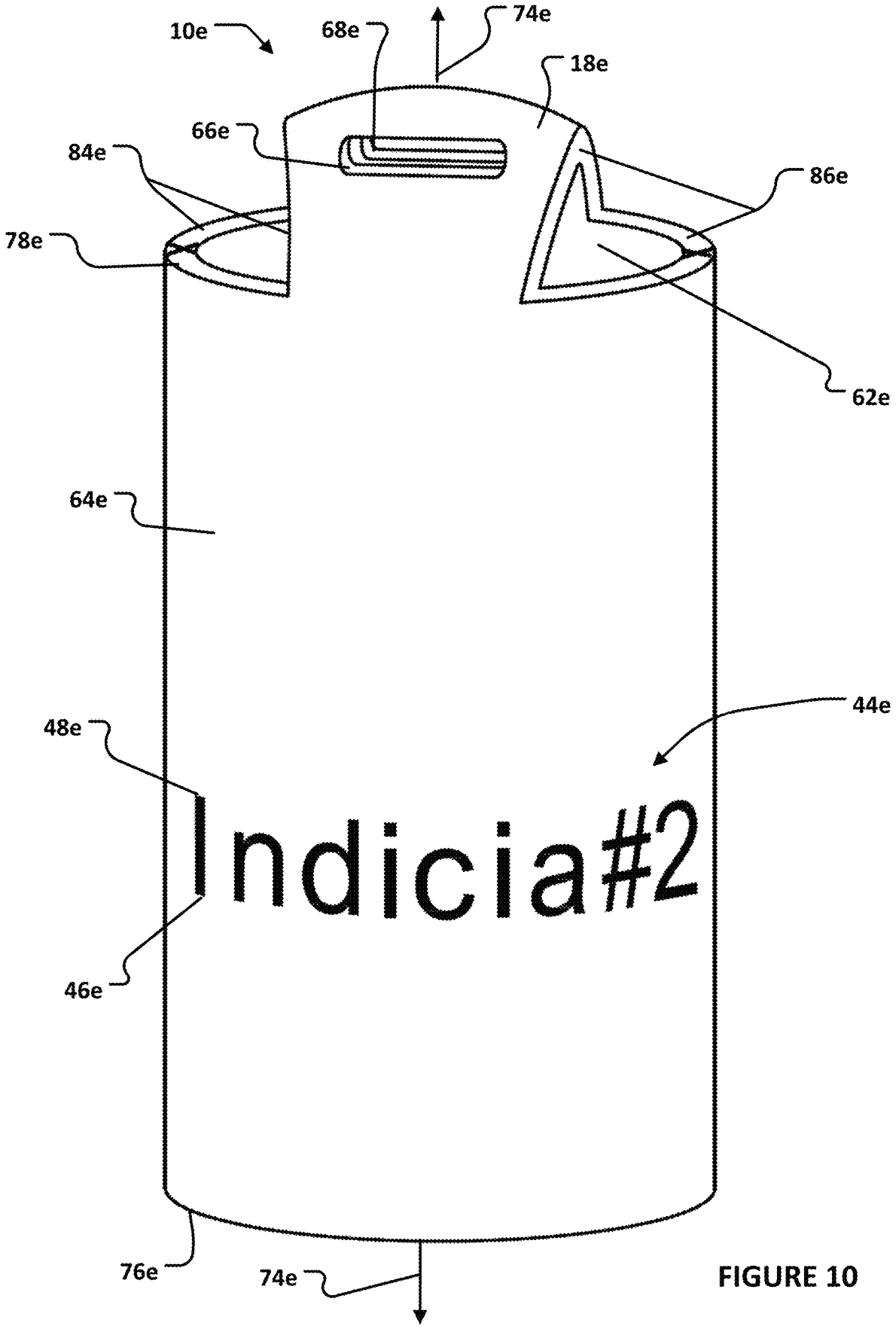
FIG. 10 is a perspective view of the beverage container insulator shown in FIG. 9 arranged inside-out for a further use.

A top surface 62 of the exemplary blank 12 that is visible in FIG. 1 can define an exterior or outside surface of the beverage container insulator 10, as shown in FIG. 5. A bottom surface 64 of the exemplary blank 12 that is visible in FIG. 2 can define an interior surface of the beverage container insulator 10, as shown in FIG. 6. FIG. 7 shows that the beverage container insulator 10 drawn "inside-out."

Figure 4:
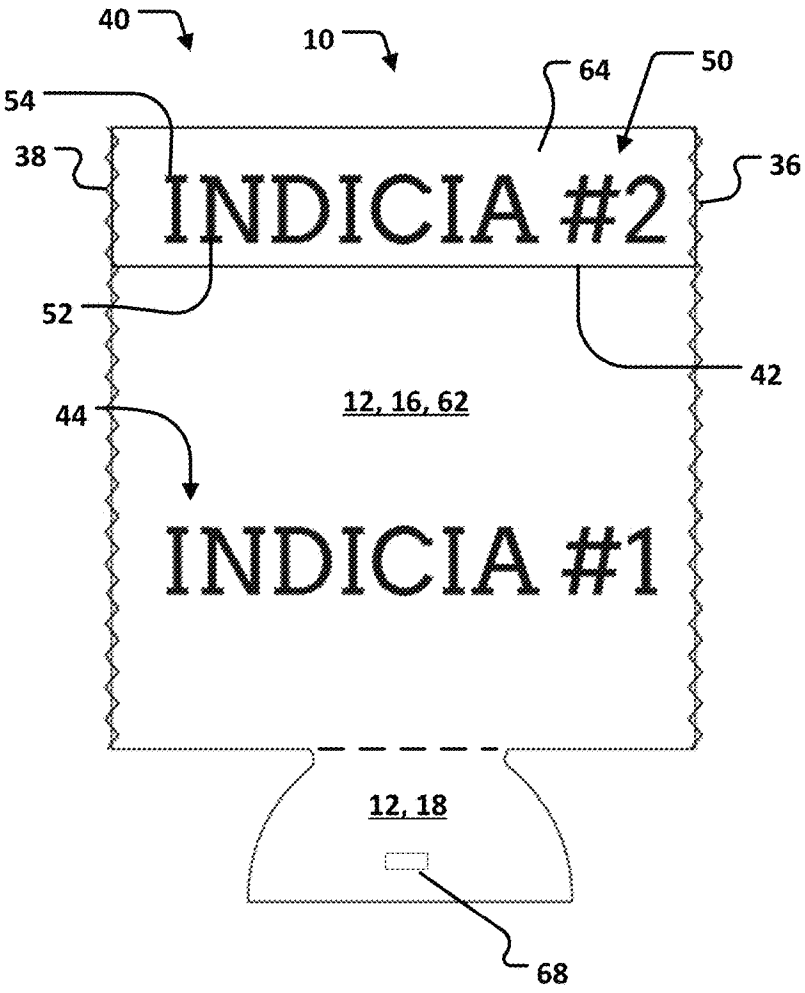
FIG. 4 is a front view of the beverage container insulator formed from the blank shown in FIGS. 1 and 2 wherein the beverage container insulator is arranged in a second configuration.
Figure 3:
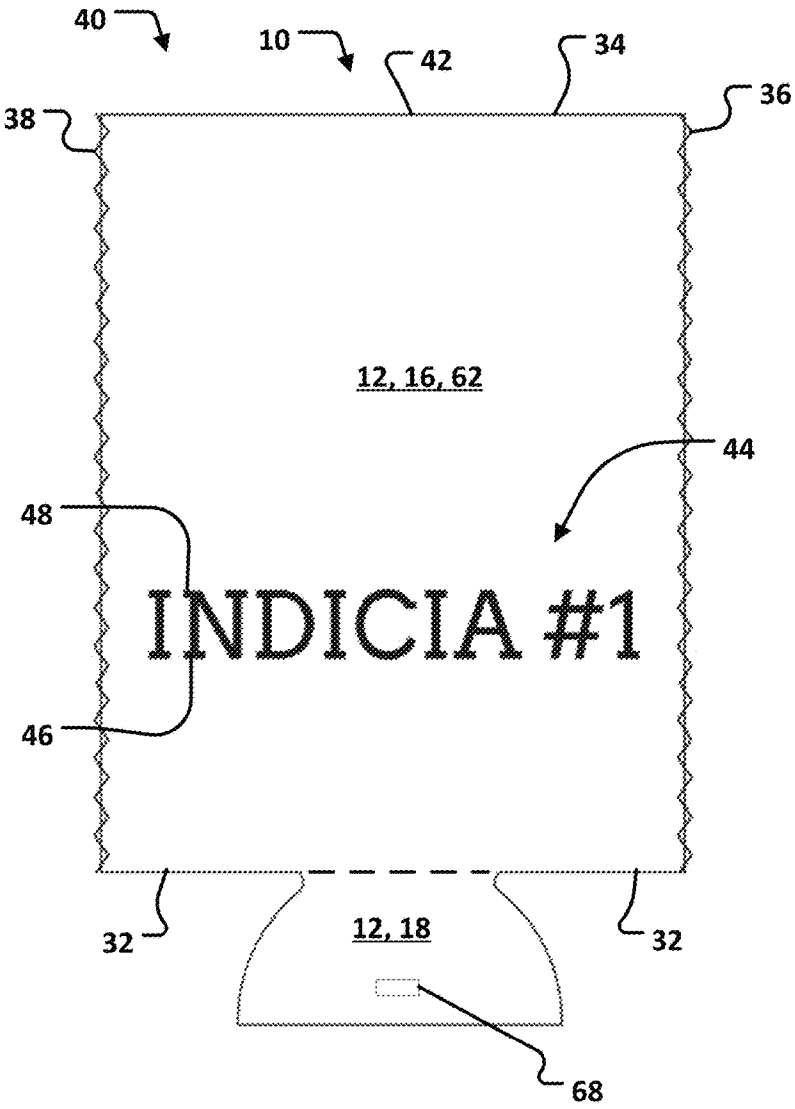
FIG. 3 is a front view of a beverage container insulator formed from the blank shown in FIGS. 1 and 2 wherein the beverage container insulator is arranged in a first configuration.

FIGS. 3 and 4 show the blank 12 further processed to form a generally cylindrical shape. The exemplary edges 20 and 28 have been fixed together with stitching 36. The exemplary edges 22 and 30 have been fixed together with stitching 38. In FIGS. 3 and 4, the beverage container insulator 10 has flattened so that one-half of the web 18 is visible. In operation, the web 18 would be flat and define a partially-closed bottom of the cylinder defined by the stitched-together panel portions 14, 16. Fold lines are represented by dashed lines in the Figures. It is noted that the stitching has been omitted in FIGS. 5 and 6 to enhance the clarity of the other structures.

Figure 2:
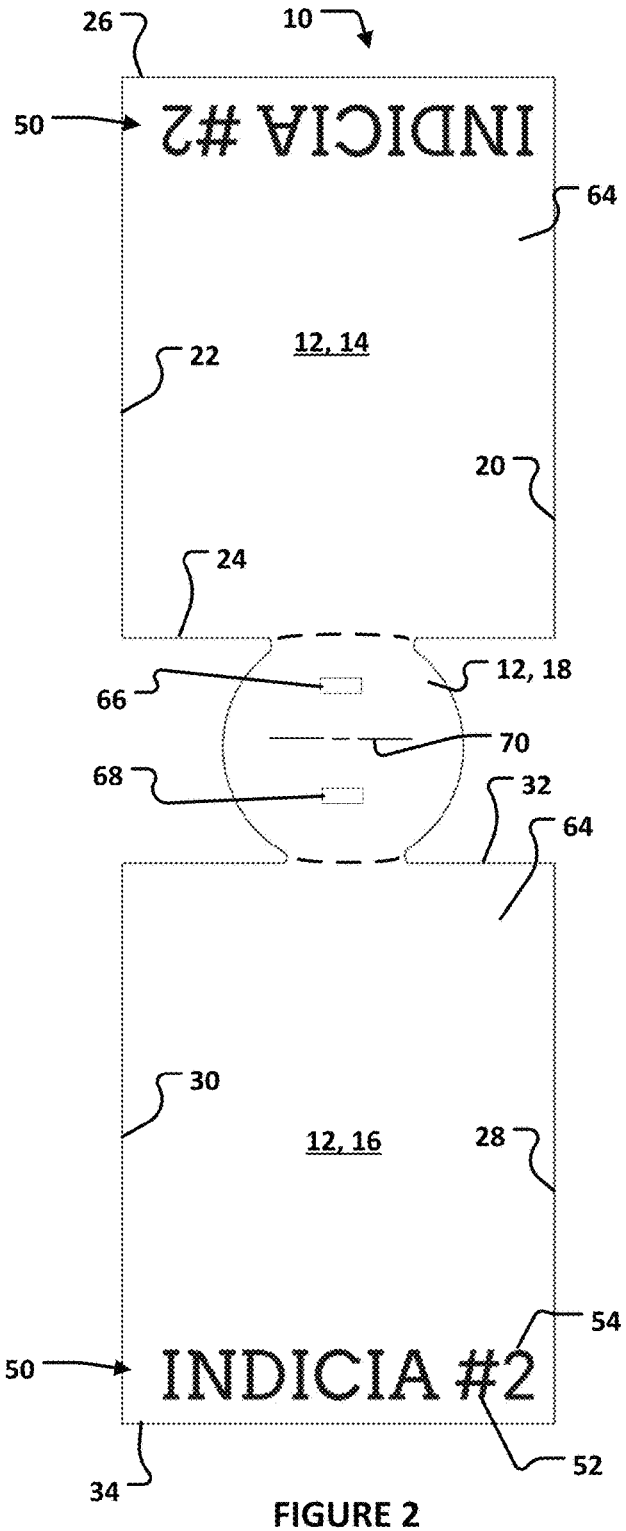
FIG. 2 is a bottom view of the blank shown in FIG. 1.

The panel portions 14, 16 and web 18 thus form a body 40 of the beverage container insulator 10. The exemplary body 40 is generally cylindrical, but could be shaped differently in other embodiments of the present disclosure. The surfaces visible in FIG. 2 shows interior surfaces of the generally-cylindrical body 40. The interior surfaces defined by the body 40 receive and contact the beverage container when the beverage container insulator 10 is in use. FIG. 1 shows exterior surfaces of the generally-cylindrical body 40. The exterior surfaces are opposite of the interior surfaces relative to the body 40.

The edges 26 and 34 cooperate to define an opening 42 of the interior of the generally-cylindrical body 40. A beverage container can be received into the body 40 through the opening 42. The web 18 defines a closed end of the interior of the generally-cylindrical body 40. A beverage container can rest on the web 18 after being received through the opening 42, while encircled by the panel portions 14, 16.

The beverage container insulator 10 also includes a first pattern 44 of indicia. The first pattern 44 of indicia is positioned on the exterior surface of body. The first pattern 44 of indicia forms readable text oriented such that a bottom edge 46 of the readable text is positioned closer to the web 18 than the opening 42. A top edge 48 of the exemplary readable text of the first pattern 44 of indicia is positioned closer to the web 18 than the opening 42. It is noted that multiple patterns of indicia can be positioned on the surface visible in FIG. 1.

The beverage container insulator 10 also includes a second pattern 50 of indicia positioned on the interior surface. The second pattern 50 of indicia forms readable text oriented such that a bottom edge 52 of the readable text is positioned closer to the opening 42 than the web 18. A top edge 54 of the readable text of the second pattern 50 of indicia is positioned closer to the opening 42 than the web 18.

As shown in FIG. 5, in operation, a beverage container insulator 10 can receive a beverage container 56 through the opening 42. The beverage container 56 can rest on the web 18 and be encircled by the panels 14, 16. The first pattern 44 of indicia forms readable text on the exterior surface of the body 40.

As shown in FIG. 6, in operation, the top end of the body 40 can then be folded over, or cuffed. A cuffed or folded-over portion of the body 40 is referenced at 58. The second pattern 50 of indicia forms readable text that is exposed on the cuffed portion 58 of the body 40. Both of the exemplary first and second panel portions 14, 16 are configured to fold-over whereby both of the first and second patterns 44, 50 of indicia can be concurrently exposed and concurrently readable.

The beverage container insulator 10 does not merely serve as a support for the first and second patterns 44, 50 of indicia. The respective, readable text defined by the first and second patterns 44, 50 of indicia are directed towards conveying a message or meaning to a human reader relevant to the beverage container. In one embodiment, the readable text of the first pattern 44 of indicia and the readable text of the second pattern 50 of indicia can convey different kinds of drinks. For example, the readable text of the first pattern 44 of indicia can display "SODA" or "COFFEE" and the readable text of the second pattern 50 of indicia can display "DIET" or "DECAF." In this way, a common beverage container insulator 10 can be utilized to insulate different kinds of beverages and advise the user of the particular beverage being insulated. The user will see "SODA" if the beverage is soda and the beverage container insulator 10 is not folded-over. Another user preferring diet soda can select a beverage being insulated by the beverage container insulator 10 when folded over so that the words "DIET" and "SODA" are visible.

In another example, the cuffed portion 58 could extend sufficiently long to cover the first pattern 44 of indicia. The readable text of the first pattern 44 of indicia can display "COLA" and the readable text of the second pattern 50 of indicia can display "ROOT BEER." The person loading the beverage container 56 in the beverage container insulator 10 can fold the opening over as necessary, based on the contents of the beverage container. Again, a single beverage container insulator 10 can be utilized for different kinds of beverages.

In yet another example demonstrating a functional relationship, in one or more embodiments of the present disclosure, the readable text of the first pattern 44 of indicia can convey a kind of beverage and the readable text of the second pattern 50 of indicia can convey nutritional information about the beverage. Further, the second pattern 50 of indicia can include horizontal lines that can be aligned with the level of the beverage in the container. For example, user can fold the body 40 over until a top edge 60 (see FIG. 6) of the cuffed portion 58 is aligned with the level of the beverage in the beverage container. The second pattern 50 of indicia can be arranged so that when this occurs that readable text informs the user of the quantity of the beverage consumed, the quantity of the beverage remaining, and/or the nutritional attributes of either quantity.

The exemplary beverage container insulator 10 also includes first and second apertures 66, 68. The exemplary first and second apertures 66, 68 are formed in the web 18. The exemplary first and second apertures 66, 68 are arranged to mirror one another on opposite sides of an axis passing through a middle of the web. This is shown in FIGS. 1 and 2 and the axis is referenced at 70.

The exemplary body 40 is configured to be selectively drawn inside-out and right-side-in. FIGS. 3 and 5 show the body 40 in the right-side-in configuration. FIG. 7 is a perspective view of the beverage container insulator arranged inside-out for a further use. FIGS. 4 and 6 show the body 40 partially folded-over, which is a configuration between inside-out and right-side-in. When the body 40 is right-side-in, the interior surface 64 is encircled by the exterior surface 62. When the body 40 is inside-out, the interior surface 64 encircles the exterior surface 62.

The first and second apertures 66, 68 are alignable with one another when the body 40 is flattened or when the web 18 is not flat as shown in FIG. 7. A structure can be received in the apertures 66, 68 so that the beverage container insulator can be hung or suspended from another structure. For example, the beverage container insulator 10 can be placed on a hook mounted on a wall. Alternatively, the beverage container insulator 10 can be hung on a briefcase with a chain or plastic tie that passes through the apertures 66, 68.

The arrangement of the indicia provides yet another advantage when combined with the feature of the apertures 66, 68. For example, the second pattern of indicia 50 can be visible when the beverage container insulator 10 is suspended and is inside-out. The indicia 50 can convey information unrelated to the beverage that is insulated by the body 40, but information that relates to the structure from which the beverage container insulator 10 is being suspended. For example, the beverage container insulator 10 can be hung from a golf bag. The indicia 50 can be the name of the owner of the golf bag and the indicia 44 can identify the beverage being insulated.

The exemplary first and second apertures 66, 68 have a rectangular perimeter. However, in other embodiments of the present disclosure, the apertures can be shaped differently. FIG. 8A-8D show various perimeters for alternatively-shaped apertures for embodiments of the beverage container insulator. It is noted that the FIGS. 8A-8D show alternative embodiments of the aperture 66 and, while not shown, the adjacent aperture 68 could be shaped the same as each alternative embodiment of the aperture 66 (the axis 70 is also shown). Aperture 66*a* is partially rectangular and includes a notch portion 72*a*. The notch portion 72*a* can receive the tie or fastener or whatever structure is used to suspend the beverage container insulator 10, so that the orientation of the beverage container insulator 10 and the indicia can be better controlled. The aperture embodiments 66*b* and 66*c* define shapes that result in the beverage container insulator 10 hanging straight down while suspended. The aperture embodiment 66*d* defines a shape that accommodates more freedom of movement of the beverage container insulator 10 while suspended. It is noted that the apertures can be practiced in embodiments of the beverage container insulator 10 not having indicia.

Another embodiment of the present disclosure is illustrated in FIGS. 9-13. An exemplary beverage container insulator 10*e* includes a body 40*e* defining a cylinder extending about an axis 74*e*. The exemplary body 40*e* defines an opening 42*e* at a first end 76*e* to receive a beverage container 56*e* and a second end 78*e* that is opposite to the first end 76*e* relative to a height 80*e* of the body 40*e*. The height 80*e* of the body 40*e* is defined along the axis 74*e* and wherein the axis 74*e* extends through a center 82*e* of the opening 42*e*.

The exemplary beverage container insulator 10*e* also includes a web 18*e* fixed with the body 40*e*. The exemplary web 18*e* partially closes the second end 78*e*. The exemplary web 18*e* is configured to prevent the beverage container 56*e* from passing fully through the body 40*e*.

The exemplary beverage container insulator 10*e* also includes first and second surfaces 64*e*, 62*e* defined on opposite sides of the body 40*e*. The exemplary first and second surfaces 64*e*, 62*e* extend along the axis 74*e* between the first and second ends 76*e*, 78*e*. At least one of the first and second surfaces 64*e*, 62*e* is configured to receive and contact the beverage container 56*e* when the beverage container 56*e* is received in the body 40*e*. In the exemplary embodiment, both of the first and second surfaces 64*e*, 62*e* are configured to receive and contact the beverage container 56*e* when the beverage container 56*e* is received in the body 40*e*.

The exemplary beverage container insulator 10*e* also includes a plurality of apertures positioned at the second end 78*e* and spaced from the first end 76*e*. Each of the exemplary plurality of apertures is defined in the web 18*e* or between the web 18*e* and the second end 78*e* of the body 40*e*. The exemplary plurality of apertures includes apertures 66*e*, 68*e*, 84*e*, and 86*e*. The plurality of apertures positioned at the second end 78*e* thus include aperture of different sizes, as shown for example by comparing apertures 66*e* and 84*e*. The plurality of apertures positioned at the second end 78*e* thus includes at least one aperture defined in the web 18*e* and also at least one aperture defined between the web 18*e* and the body 40*e*, as shown in exemplary apertures 68*e* and 86*e*. The plurality of apertures positioned at the second end 78*e* thus includes more than one aperture defined between the web 18*e* and the body 40*e* (apertures 84*e* and 86*e*).

The exemplary apertures 66*e* and 68*e* formed in the web 18*e* are arranged to mirror one another on opposite sides of the axis 74*e*. The exemplary axis 74*e* passes through a middle of the web 18*e*. The exemplary apertures 66*e*, 68*e* have a rectangular perimeter. The exemplary apertures 66*e*, 68*e* are alignable with one another when the body 40*e* is flattened.

The body 40*e* is flexible and selectively configurable between a first configuration and a second configuration. In the first configuration, shown in FIG. 11, the first surface 64*e* confronts the axis 74*e* and the second surface 62*e* faces away from the axis 74*e*. In the second configuration, shown in FIG. 10, the second surface 62*e* confronts the axis 74*e* and the first surface 64*e* faces away from the axis 74*e*. The second configuration defines the body 40*e* being folded inside-out relative to the body 40*e* in the first configuration. The body 40*e* is operable/configured to receive and insulate the beverage container 56*e* in both of the first configuration and the second configuration.

The exemplary beverage container insulator 10*e* also includes a first pattern of indicia 44*e* positioned on the first surface 64*e*. The first pattern of indicia 44*e* forms readable text oriented such that a bottom edge 46*e* of the readable text is positioned closer to the opening 42*e* than the web 18*e*. The exemplary beverage container insulator 10*e* also includes a second pattern of indicia 50*e* positioned on the second surface 62*e*. The second pattern of indicia 50*e* forms readable text oriented such that a bottom edge 52*e* of the readable text is positioned closer to the web 18*e* than the opening 42*e*. A top edge 48*e* of the readable text of the first pattern of indicia 44*e* is positioned a first distance from the opening 42*e* along the axis 74*e*. A top edge 54*e* of the readable text of the second pattern of indicia 50*e* is positioned a second distance from the opening 42*e* along the axis 74*e*. The first distance is less than the second distance. The body 40*e* is configured to fold over about the opening 42*e*, whereby both of the first and second patterns of indicia 44*e*, 50*e* are concurrently exposed and concurrently readable.

The exemplary beverage container insulator 10*e* also includes a closure assembly 88*e* positioned on the body 40*e* at the first end 76*e* and spaced from the second end 78*e*. The exemplary closure assembly 88*e* is positioned closer to the first end 76*e* along the axis 74*e* than the exemplary plurality of apertures 66*e*, 68*e*, 84*e*, 86*e*. The exemplary closure assembly 88*e* includes first and second closure members 90*e*, 92*e* affixed to opposite portions of the second surface 62*e* of the body 40*e* at the opening 42*e*. The first and second closure members 90*e*, 92*e* are selectively engageable with one another to selectively and substantially close the center 82*e* of the opening 42*e*.

Figure 12:
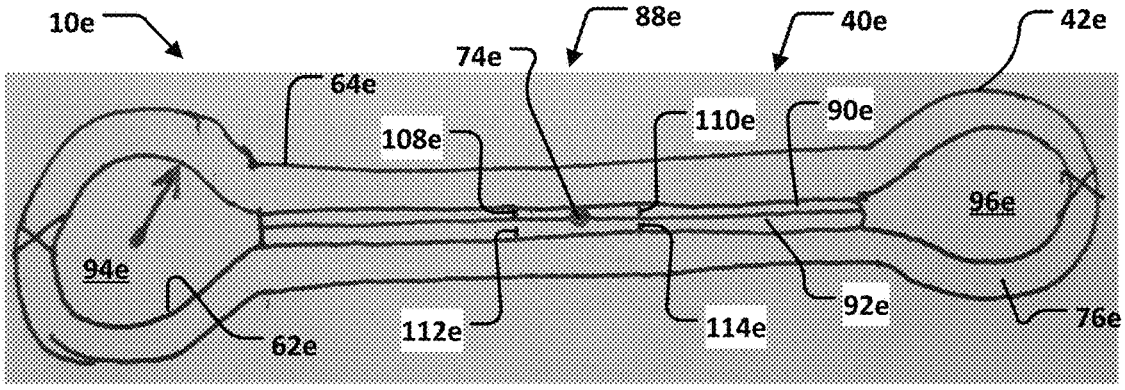
FIG. 12 is a top view, looking downward, at a closure assembly closing the opening at the top of a body of the beverage container insulator shown in FIGS. 9 and 10.
Figure 13:
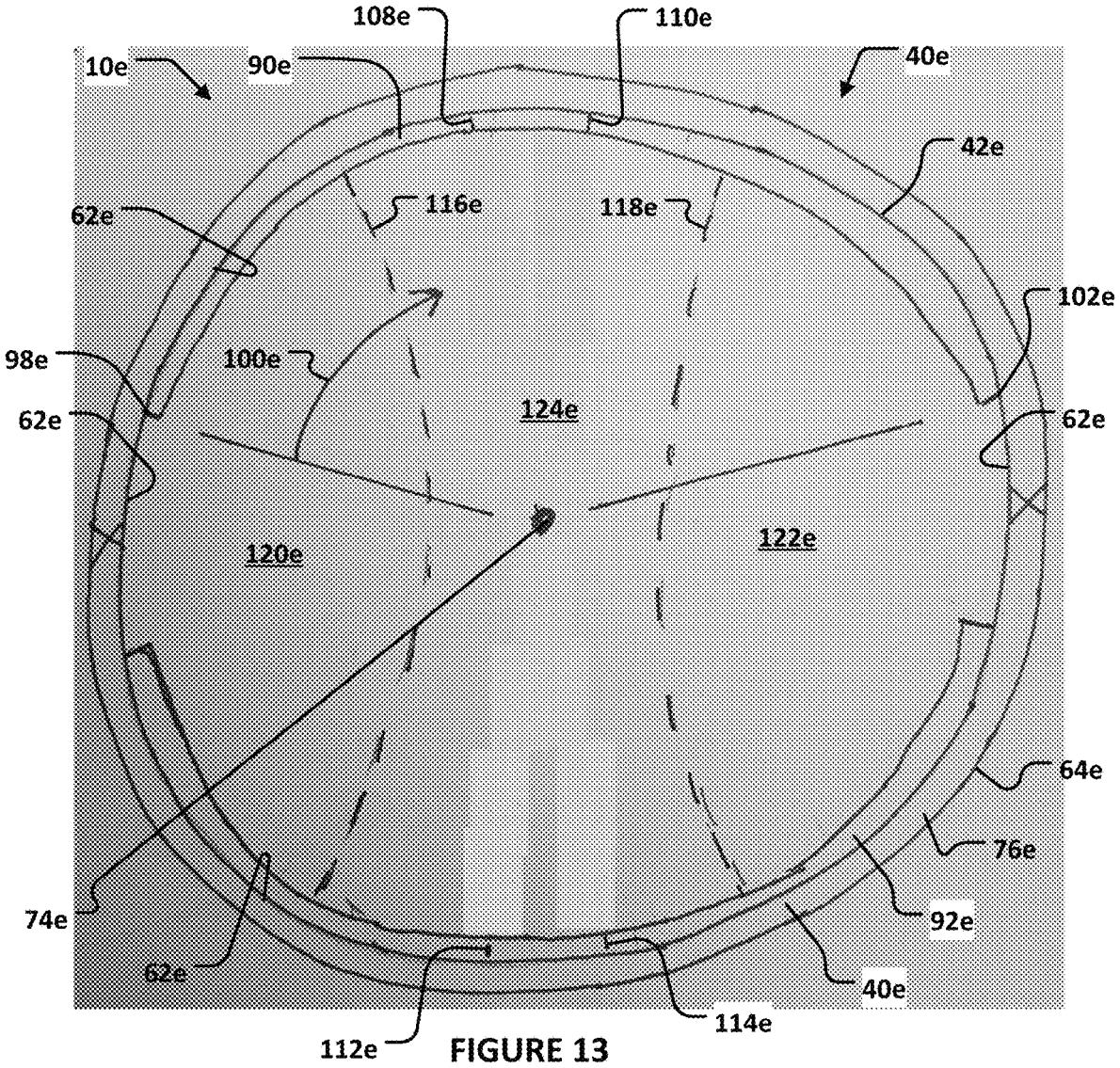
FIG. 13 is a top view, looking downward, at the opening at the top of the body of the beverage container insulator shown in FIGS. 9 and 10, before the opening is closed as shown in FIG. 11.

Selectively in that the opening 42*e* can be repeatedly opened and closed, without damage. Substantially in that an area of the opening 42*e* can be reduced fifty to one hundred percent, or some other range. FIG. 13 shows the opening 42*e* "fully open" and FIG. 12 shows the opening 42*e* closed by the exemplary first and second closure members 90*e*, 92*e*. Areas of the opening 42*e* that remain open after the exemplary first and second closure members 90*e*, 92*e* are engaged are referenced at 94*e* and 96*e*. The areas 94*e* and 96*e* are circular and the same size. In one or more embodiments of the present disclosure, the opening 42*c* can be fully closed when the exemplary first and second closure members 90*e*, 92*e* are engaged.

The opening 42*e* can be closed so that the exemplary beverage container insulator 10*e* can be utilized to carry something other than the beverage container 56*e*. Therefore, the extent of the reduction in the open area of the opening 42*e* can be chosen based on what will be carried. If, for example, a relatively wide object such as a mobile phone is to be carried, the areas 94*e*, 96*e* can be relatively larger. Alternatively, if a relatively narrow object such as a key or coin(s) is to be carried, the areas 94*e*, 96*e* can be relatively small or eliminated entirely.

The first and second closure members 90*e*, 92*e* can take any desired form. The exemplary first closure member 90*e* is a pad of hook fasteners and the exemplary second closure member 92*e* is a pad of loop fasteners. The axis 74*e* is positioned directly between the exemplary first and second closure members 90*e*, 92*e* when the first and second closure members 90*e*, 92*e* are engaged with one another, as shown in FIG. 12.

Each of the exemplary first and second closure members 90*e*, 92*e* cover respective first and second portions of the second surface 62*e*. The exemplary portions are underneath the exemplary first and second closure members 90*e*, 92*e*. The respective first and second portions mirror each other across a plane normal to the axis 74*e*, as shown by FIG. 13 which is planar view of such a plane. The respective first and second portions extend respective arc lengths about the axis 74*e*. One such arc begins at a point referenced at 98*e* in FIG. 13, extends about the axis 74*e* in the direction referenced by arrow 100*e* along the surface 62*e*, and ends at a point referenced at 102*e*. As referenced in FIG. 9, each of exemplary the first and second closure members 90*e*, 92*e* have a respective maximum height 104*e*, 106*e* defined along the axis 74*e*. The exemplary heights 104*e*, 106*e* are constant and the same. At least one of the arc lengths can be greater than both of the heights 104*e*, 106*e*. In the exemplary embodiment, both of the arc lengths are greater than both of the heights 104*e*, 106*e*.

As set forth above, the axis 74*e* is positioned directly between the exemplary first and second closure members 90*e*, 92*e* when the first and second closure members 90*e*, 92*e* are engaged with one another. The exemplary first and second closure members 90*e*, 92*e* define continuous pads and the axis 74*e* is between the pads. In other embodiments, the exemplary first and second closure members 90*e*, 92*e* can be discontinuous and a gap between the exemplary first and second closure members 90*e*, 92*e* can be defined, such as at the axis 74*e*. Dashed lines referenced at 108*e*, 110*e*, 112*e*, 114*e* represent edges of pads that could be utilized in one or more alternative embodiments of the present disclosure. Gaps would exist between edges 108*e* and 110*e*, as well as between edges 112*e* and 114*e*.

In one or more embodiments of the present disclosure, a cumulative area of the plurality of apertures at the second end 78*e*, in a plane normal to the axis 74*e*, can be at least as large as an area of the web 18*e* in the plane. FIG. 13 shows such a plane. The exemplary web 18*e* is circular and sized to substantially cover the entire second end 78*e*. Dashed lines referenced at 116*e* and 118*e* represent edges of a web that could be utilized in one or more alternative embodiments of the present disclosure. The area in FIG. 13 bounded by the line 116*e* and the portion of surface 62*e* to the right, referenced at 120*e*, would define a aperture larger than aperture 84*e*. The area in FIG. 13 bounded by the line 118*e* and the portion of surface 62*e* to the left, referenced at 122*e*, would define a aperture larger than aperture 86*e*. The web of the embodiment would be defined between the line 116*e*, the line 118*e*, and the upper and lower portions of the surface 62*e*. The web of the embodiment is referenced at 124*e*. The web 124*e* would prevent a beverage container from passing through the body 40*e*.

Figure 11:
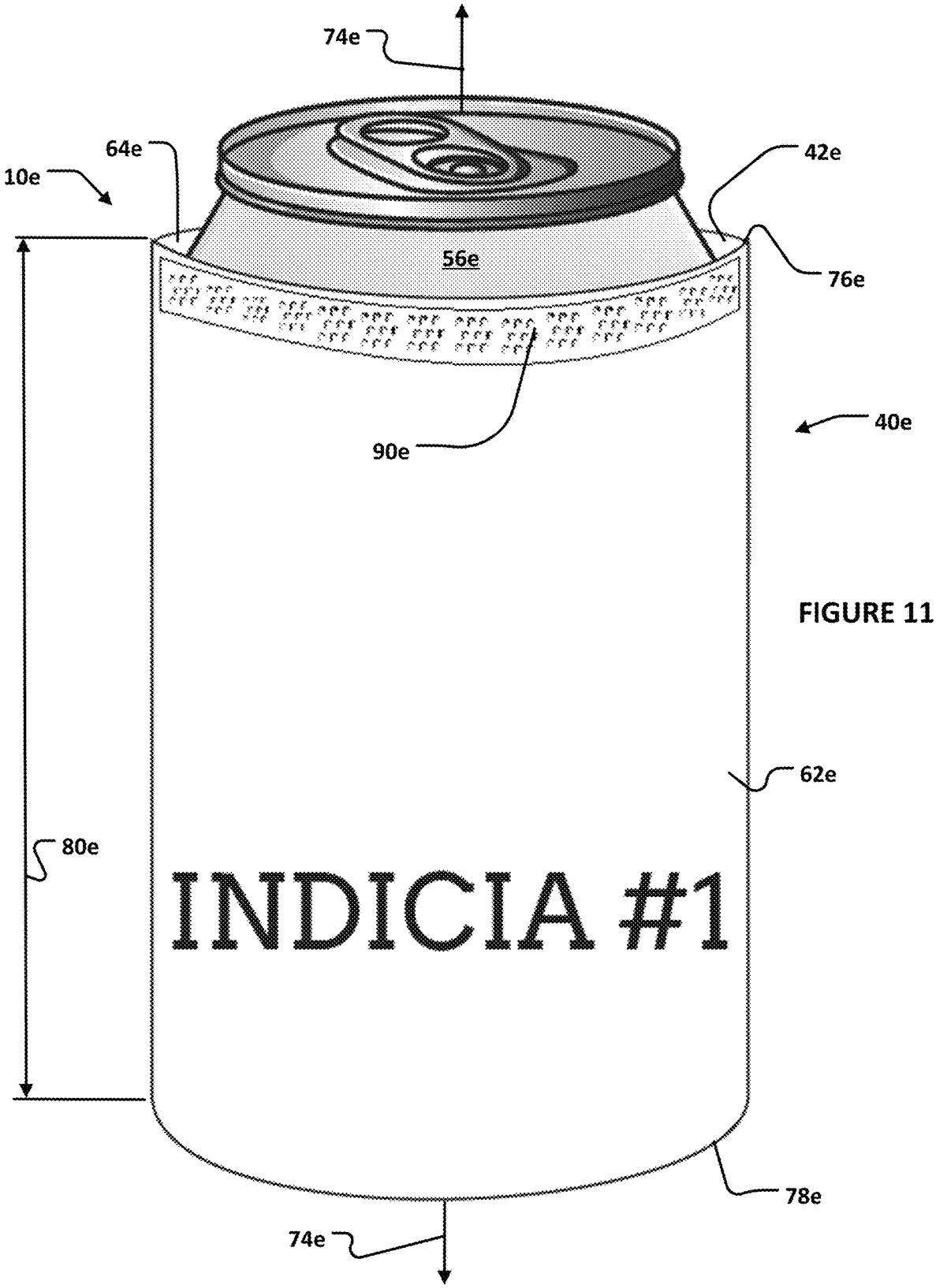
FIG. 11 is a perspective view of the beverage container insulator shown in FIG. 9 mounted on a beverage container and arranged in a first configuration (unfolded)

In one exemplary operation, the beverage container 56*e* can be received in the surface 64*e* of the beverage container insulator 10*e*, while the beverage container insulator 10 is in the first configuration. This is shown in FIG. 11. The beverage container 56*e* can be removed from the body 40*e*, the body 40*e* can be folded inside-out to the second configuration, and the body 40*e* can be hung from another structure, such as a golf bag, a golf cart, a bicycle, or a stationary structure. The body 40*e* can be hung by passing a cord or tie through the apertures 66*e* and 68*e*.

The user can then place an object in the body 40*e* through the opening 42*e* and close the opening 42*e* with the closure assembly 88*e*. Alternatively, the user may close the opening 42*e* and insert the object into the body 40*e* through the one of the apertures 84*e* or 86*e*. Subsequently, the user can remove the object from the body 40*e*, through the opening 42*e* or one of the apertures 84*e* or 86*e*, and insert another beverage container in the body 40*e* through the opening 42*e*.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. The right to claim elements and/or subcombinations that are disclosed herein is hereby unconditionally reserved. The use of the word "can" in this document is not an assertion that the subject preceding the word is unimportant or unnecessary or "not critical" relative to anything else in this document. The word "can" is used herein in a positive and affirming sense and no other motive should be presumed. More than one "invention" may be disclosed in the present disclosure; an "invention" is defined strictly by the content of a patent claim and not by what is written in a detailed description of an embodiment of an invention.

What is claimed is:

1. A beverage container insulator comprising:

a body defining a cylinder extending about an axis and having an opening at a first end to receive a beverage container and a second end that is opposite to said first end relative to a height of said body wherein said height is defined along said axis and wherein said axis extends through a center of said opening;

a web fixed with said body, at least partially closing said second end, and configured to prevent the beverage container from passing fully through said body;

first and second surfaces defined on opposite sides of said body and extending along said axis between said first and second ends, at least one of said first and second surfaces configured to receive and contact the beverage container when the beverage container is received in said body;

a closure assembly positioned on said body at said first end and spaced from said second end, said closure assembly positioned closer to said first end along said axis than said second end, said closure assembly having first and second closure members affixed to opposite portions of said second surface of said body at said opening, said first and second closure members selectively engageable with one another to selectively and substantially close said center of said opening.

2. The beverage container insulator of claim 1 wherein:

said first closure member is further defined as a pad of hook fasteners; and said second closure member is further defined as a pad of loop fasteners.

3. The beverage container insulator of claim 1 wherein said axis is positioned directly between said first and second closure members when said first and second closure members are engaged with one another.

4. The beverage container insulator of claim 1 wherein each of said first and second closure members cover respective first and second portions of said second surface, said respective first and second portions mirror each other across a plane normal to said axis, said respective first and second portions extend respective arc lengths about said axis, each of said first and second closure members have a respective maximum height defined along said axis, and at least one of said arc lengths is greater than both of said respective maximum heights.

5. The beverage container insulator of claim 1 wherein said body is flexible and selectively configurable between a first configuration and a second configuration, in said first configuration said first surface confronts said axis and said second surface faces away from said axis, in said second configuration said second surface confronts said axis and said first surface faces away from said axis, and said second configuration being said body folded inside-out relative to said body in said first configuration.

6. The beverage container insulator of claim 5 wherein said body is operable to receive and insulate the beverage container in both of said first configuration and said second configuration.

7. The beverage container insulator of claim 1 further comprising:

a plurality of apertures positioned at said second end and spaced from said first end, each of said plurality of apertures defined in said web or between said web and said second end of said body, wherein said plurality of apertures positioned at said second end includes apertures of different sizes.

8. The beverage container insulator of claim 1 further comprising:

a plurality of apertures positioned at said second end and spaced from said first end, each of said plurality of apertures defined in said web or between said web and said second end of said body, wherein said plurality of apertures positioned at said second end includes at least one aperture defined in said web and also at least one aperture defined between said web and said body.

9. The beverage container insulator of claim 1 further comprising:

a plurality of apertures positioned at said second end and spaced from said first end, each of said plurality of apertures defined in said web or between said web and said second end of said body, wherein said plurality of apertures positioned at said second end includes more than one aperture defined between said web and said body.

10. The beverage container insulator of claim 1 further comprising:

a plurality of apertures positioned at said second end and spaced from said first end, each of said plurality of apertures defined in said web or between said web and said second end of said body, wherein a cumulative area of said plurality of apertures at said second end, in a plane normal to said axis, is at least as large as an area of said web in said plane.

11. The beverage container insulator of claim 1 further comprising:

a first pattern of indicia positioned on said first surface, said first pattern of indicia forming readable text oriented such that a bottom edge of said readable text is positioned closer to said opening than said web; and a second pattern of indicia positioned on said second surface, said second pattern of indicia forming readable text oriented such that a bottom edge of said readable text is positioned closer to said web than said opening.

12. The beverage container insulator of claim 11 wherein a top edge of said readable text of said first pattern of indicia is positioned a first distance from said opening along said axis, a top edge of said readable text of said second pattern of indicia is positioned a second distance from said opening along said axis, and said first distance is less than said second distance.

13. The beverage container insulator of claim 12 wherein said body is configured to fold over about said opening whereby both of said first and second patterns of indicia are concurrently exposed and concurrently readable.

14. The beverage container insulator of claim 1 further comprising:

a plurality of apertures positioned at said second end and spaced from said first end, each of said plurality of apertures defined in said web or between said web and said second end of said body, wherein said plurality of apertures includes first and second apertures formed in said web arranged to mirror one another on opposite sides of said axis and wherein said axis passes through a middle of said web.

15. The beverage container insulator of claim 14 wherein at least one of said first and second apertures has a rectangular perimeter.

16. The beverage container insulator of claim 14 wherein said first and second apertures are alignable with one another when said body is flattened.

* * * * *